US011299864B2

(12) United States Patent
Li

(10) Patent No.: US 11,299,864 B2
(45) Date of Patent: Apr. 12, 2022

(54) JETTING, EXPANSION AND EXTRUSION COMBINED PILE, CONSTRUCTION METHOD THEREOF AND SPIRAL JETTING, EXPANSION AND EXTRUSION DRILLING RIG USED IN METHOD

(71) Applicant: SHANDONG BEI TE LI FOUNDATION ENGINEERING TECHNOLOGY CO., LTD, Jining Shandong (CN)

(72) Inventor: Jinliang Li, Jining Shandong (CN)

(73) Assignee: SHANDONG BEI TE LI FOUNDATION ENGINEERING TECHNOLOGY CO., LTD, Shandong (CN)

( * ) Notice: Subject to any disclaimer, the term of this patent is extended or adjusted under 35 U.S.C. 154(b) by 0 days.

(21) Appl. No.: 16/962,439

(22) PCT Filed: Sep. 6, 2018

(86) PCT No.: PCT/CN2018/101264
§ 371 (c)(1),
(2) Date: Jul. 15, 2020

(87) PCT Pub. No.: WO2019/148812
PCT Pub. Date: Aug. 8, 2019

(65) Prior Publication Data

US 2020/0362527 A1 Nov. 19, 2020

(30) Foreign Application Priority Data

Jan. 30, 2018 (CN) ..... 201810087422.5

(51) Int. Cl.
*E02D 5/36* (2006.01)
*E02D 15/04* (2006.01)

(52) U.S. Cl.
CPC ..... *E02D 5/36* (2013.01); *E02D 15/04* (2013.01); *E02D 2250/003* (2013.01); *E02D 2250/0023* (2013.01); *E02D 2300/002* (2013.01)

(58) Field of Classification Search
CPC ..... E02D 15/04; E02D 2250/0023; E02D 2250/003; E02D 2300/002; E02D 5/36;
(Continued)

(56) References Cited

U.S. PATENT DOCUMENTS 3,969,902 A * 7/1976 Ichise ..... E02D 5/12 405/267
5,934,836 A * 8/1999 Rupiper ..... E21B 10/44 405/244
2016/0244932 A1* 8/2016 Peng ..... E02D 5/34

FOREIGN PATENT DOCUMENTS

CN 1391011 A 1/2003
CN 1844588 A 10/2006
(Continued)

OTHER PUBLICATIONS

Office Action dated Jun. 12, 2019 issued in corresponding CN Application No. 2018100874225.

*Primary Examiner* — Carib A Oquendo
(74) *Attorney, Agent, or Firm* — Muncy, Geissler, Olds & Lowe, P.C.

(57) ABSTRACT

The present invention discloses a jetting, expansion and extrusion combined pile, a construction method thereof and a spiral jetting, expansion and extrusion drilling rig used in the method. A pile of the combined pile comprises a pile body (101), an expanded body (103) and a pile end (106). At least one double-frustum-shaped expanded body (103), which is integrally formed with the pile body (101), is arranged on the pile body (101). The expanded body (103) is located in a vertical soil layer position, which has higher
(Continued)

(a) Drilling
(b) Performing rotary jet grouting on the cement slurry, and simultaneously filling concrete under pressure
(c) Forming a plain concrete pile
(d) Inserting a reinforcement cage deformation modulus and shear strength, of the pile body (101), and at least two wing plates (102) which are uniformly distributed in the circumference direction and basically perpendicular to the axis of the pile are arranged on the pile body (101). The diameter of the pile above the expanded body (103) is larger than or equal to that of the pile below the expanded body (103). The drilling rig in the present invention comprises an upper section and a lower section, the diameter of the upper section is larger than that of the lower section, and the expanded body can be produced in any required position conveniently. When the expanded body (103) is located at the upper part or in the middle of the combined pile, if the diameter of the pile above the expanded body (103) is larger than that of the pile below the expanded body (103), the consumption of concrete can be greatly reduced.

14 Claims, 5 Drawing Sheets

(58) Field of Classification Search
CPC ... E02D 5/46; E02D 5/48; E21B 7/002; E21B 7/005
See application file for complete search history.

(56) References Cited

FOREIGN PATENT DOCUMENTS

| | | | |
|---|---|---|---|
| CN | 102162248 | A | 8/2011 |
| CN | 102877466 | A | 1/2013 |
| CN | 105220714 | A | 1/2016 |
| CN | 106087999 | A | 11/2016 |
| CN | 108330959 | A | 7/2018 |
| CN | 208088286 | U | 11/2018 |

* cited by examiner (a) Drilling (b) Performing rotary jet grouting on the cement slurry, and simultaneously filling concrete under pressure (c) Forming a plain concrete pile (d) Inserting a reinforcement cage

JETTING, EXPANSION AND EXTRUSION COMBINED PILE, CONSTRUCTION METHOD THEREOF AND SPIRAL JETTING, EXPANSION AND EXTRUSION DRILLING RIG USED IN METHOD

FIELD

The present invention generally relates to a concrete pile, and in particular relates to a cast-in-situ concrete pile, a construction method and a drilling rig.

BACKGROUND

At present, along with adjustment and development of the construction industry, the requirement of the construction engineering on foundation design and construction has become higher and higher, therefore, concrete piles are widely used in high-rise buildings, bridges, high-speed railways, ports and other construction projects.

In order to enable a pile foundation to satisfy architectural design requirements of anti-deformation, seismic capacity and bearing capacity, the bearing capacity is often improved through lengthening a pile or increasing the diameter of a pile. However, lengthening or increasing the pile will both lead to an increase in the consumption of concrete, especially when the ratio of the length to diameter of the pile is overlarge, the bearing capacity of the pile will be dramatically decreased, and it is often useless to improve the bearing capacity of the pile through lengthening or increasing the diameter of the pile, meanwhile, a large amount of concrete will be bound to waste, sometimes, mechanical equipment is used to make the soil layer around the compaction pile into piles, the consumed energy is great, and the construction speed is low.

The invention patent application CN201710434805.0 and the utility model patent ZL 201720669956.X of the present applicant propose a spiral spray-irrigation extrusion combination device. The spiral spray-irrigation extrusion combination device includes a hollow drill rod, a power head and a multifunctional diverter. The power head is installed at the upper end of the hollow drill rod, a straight pipe connector is installed above the power head, one side of the straight pipe connector is connected with a concrete conveying bent pipe, and the multifunctional diverter is installed at the upper end of the straight pipe connector. A grout passing connector, a gas passing connector and a water passing connector are arranged on the side face of the multifunctional diverter, a high-pressure grout (grout, gas or grout, gas and water) injection pipe is installed on the hollow drill rod from top to bottom, and multiple layers of grout (grout, gas or grout, gas and water) injection nozzles are arranged at the lower end of the high-pressure grout (grout, gas or grout, gas and water) injection pipe. A drill bit is installed at the bottom of the hollow drill rod, and a hinge-type valve is installed on the plane of the central tube of the drill rod at the lower end of the drill bit. A limiting baffle is arranged on the back face of the hinge-type valve, a latch-type lock is arranged at the open side of the hinge-type valve, and a drill tip is arranged at the lower surface of the hinge-type valve. The device can be adopted to manufacture a spray-irrigation extrusion combined pile.

The invention patent application CN201710183031.9 and the utility model patent ZL201720295981.6 of the present applicant propose a spray-irrigation extrusion combined pile. The combined pile body includes a pile cap, a pile body and an expanded body in sequence from top to bottom, and the pile cap, the pile body and the expanded body are integrated. The pile cap is a superfluid concrete pile cap which is filled under pressure when the outer drill tube of the pressure pouring inverted cone step-shaped drill rod forms a hole. The pile body is formed when a polygon, which is subject to directional jet grouting with high-pressure cement slurry, is extruded into a polygonal superfluid concrete pile body through the vibration of a drill rod. The expanded body is a high-pressure jet grouting inverted frustum-shaped rigid expanded body which is formed when a drill bit vibrates to extrude the superfluid concrete to form a concrete expanded head and which is externally wrapped with a layer of compacted cement soil and concrete. The spray-irrigation extrusion combined pile has the following advantages: the bigger concrete frustum-shaped big head extruded at the pile end is provided with a layer of cement soil mixed with cement outside, and is provided with a compacted soil layer still outside, the pile body is sprayed into a polygon, to increase the friction resistance area at the pile side, a reinforcement cage is inserted into the superfluid concrete in the pile hole, to form the soil layer around the superfluid concrete compacted pile hole, that is, to form the spray-irrigation extrusion combined pile, and the combined pile can improve the bearing capacity of a single pile.

However, since the expanded body is arranged at the tail end of the pile, that is, the position of the pile end, the application range of the combined pile is greatly limited. Under complicated geological conditions, for example, when the depth of the position at which a bearing layer with higher shear strength is located is shallow, while for the combined pile, since the expanded body is arranged at the pile end, the bearing capacity of a single pile cannot satisfy the design requirements. Therefore, to solve the above problem, the combined pile, the construction method and the used drilling rig in the above patent urgently need to be improved.

SUMMARY

A first objective of the present invention is to provide a jetting, expansion and extrusion combined pile.

A second objective of the present invention is to provide a construction method of the above combined pile.

A third objective of the present invention is to provide a spiral jetting, expansion and extrusion drilling rig.

The adopted technical solutions are specifically as follows:

A jetting, expansion and extrusion combined pile with a high bearing capacity is provided, and the pile is composed of a pile body, an expanded body and a pile end, wherein at least one double-frustum-shaped expanded body, which is integrally formed with the pile body, is arranged on the pile body.

The jetting, expansion and extrusion combined pile of the present invention is provided, wherein the pile is internally provided with a reinforcement cage.

The jetting, expansion and extrusion combined pile of the present invention is provided, wherein the expanded body is located in a vertical bearing layer position, which has higher deformation modulus and shear strength, of the pile body, and at least two wing plates which are uniformly distributed in the circumference direction and basically perpendicular to the axis of the pile are arranged on the pile body.

The jetting, expansion and extrusion combined pile of the present invention is provided, wherein the diameter of the pile above the expanded body is larger than or equal to that of the pile below the expanded body.

The jetting, expansion and extrusion combined pile of the present invention is provided, wherein the included angle α between the lower inclined plane of the expanded body and the central axis of the pile is in a range of greater than or equal to 10° and less than or equal to 80°.

The jetting, expansion and extrusion combined pile of the present invention is provided, wherein the wing plate has a width of 5-25 cm and a thickness of 2-12 cm.

A construction method of the jetting, expansion and extrusion combined pile of the present invention includes the following steps:

(1) drilling to a designed depth through a drilling rig, and stopping drilling;

(2) adjusting the nozzle pressure of a grout injection nozzle on a drill rod to 2-40 MPa, and adjusting the lifting speed of the drill rod to 6-60 cm/min; and while lifting the spiral hollow drill rod, performing rotary jet grouting on cement slurry at the designed depth with a nozzle on the grout injection nozzle, and vibrating a drill rod to fill under pressure the superfluid concrete to manufacture a double-frustum-shaped expanded body to a set elevation, with a height being 0.5-3.0 m; and (3) adjusting the lifting speed of the drill rod to 0.5-2 m/min, keeping the nozzle pressure to be unchanged, changing from performing rotary jet grouting to performing directional jet grouting on the wing plate of the pile body, and simultaneously filling under pressure the superfluid concrete to a designed elevation, to form a plain concrete pile.

Any of the construction method of the present invention is provided, wherein after a plain concrete pile is formed, a reinforcement cage is inserted into the superfluid concrete in a pile hole to a designed depth, to form a reinforced concrete foundation pile.

The spiral jetting, expansion and extrusion drilling rig adopted in any of the construction methods in the present invention includes a spiral hollow drill rod and a power head, and a high-pressure grout injection pipe is installed from top to bottom at one side of an outer wall or an inner wall of a core tube of the spiral hollow drill rod, wherein the spiral hollow drill rod includes an upper drill rod and a lower drill rod, wherein the upper drill rod and the lower drill rod are connected together through a flange, the radius of the helical blade of the upper drill rod is larger than the radius of the helical blade of the lower drill rod, the lower end of the high-pressure grout injection pipe is provided with multiple layers of grout injection nozzles, and each layer of grout injection nozzle is located below the outer edge of the helical blade at the bottom of the upper drill rod.

The spiral jetting, expansion and extrusion drilling rig of the present invention is provided, wherein the length $l_1$ of the upper drill rod is larger than 5 m, the length $l_2$ of the lower drill rod is larger than 6 m, the diameter d of the upper drill rod is equal to 700 mm to 800 mm, and the diameter $d_1$ of the lower drill rod is equal to 500 mm to 600 mm, and d is equal to the sum of $d_1$ and 0.2 m.

The spiral jetting, expansion and extrusion drilling rig of the present invention is provided, wherein the number of layers of the grout injection nozzles is 2-10.

The spiral jetting, expansion and extrusion drilling rig of the present invention is provided, wherein each layer of grout injection nozzle is provided with 1-6 nozzles, the bearing pressure of each nozzle is 2-40 MPa, wherein the bearing pressure is preferably 25 MPa in a soil layer, and is preferably 20 MPa in a sand layer.

The spiral jetting, expansion and extrusion drilling rig of the present invention is provided, wherein the spacing between two adjacent upper and lower grout injection nozzles is 5-30 cm, wherein the spacing is preferably 15 cm in a soil layer, and is preferably 20 cm in a sand layer, the horizontal spacing between two adjacent nozzles in each layer of grout injection nozzle is 1-6 cm, wherein the horizontal spacing is preferably 2-4 cm in a soil layer, and is preferably 4-6 cm in a sand layer, and the diameter of the nozzle is 2-10 mm.

The spiral jetting, expansion and extrusion drilling rig of the present invention is provided, wherein the number of layers of the grout injection nozzles is 3, each layer of grout injection nozzle is provided with two nozzles, and the diameter of the nozzle is 2 mm.

The pile of the combined pile has the advantages of multiple advanced piles including a jet grouting pile, a pressure grouting pile, an inverted cone step pile, a grouting pile and a spray wing plate pile, and innovates the dedicated drilling rig, wherein multiple layers of nozzles can be used to repeatedly spray the underground soil layer at a high pressure, to manufacture a double-frustum wedge-shaped expanded body, and to extrude the superfluid concrete to compact the soil layer under the vibration of a drill rod, therefore, the process is simple, the technology is advanced, the cost is low, and the quality is favorable. Wherein an inverted cone-shaped expanded body of a jetting, expansion and extrusion combined pile with a high bearing capacity is preferably manufactured by selecting a proper soil layer with higher deformation modulus and shear strength on the soil layer of a pile body in a geological report.

Analysis on stress and deformation of the combined pile manufactured in the present invention:

(1) After loading on a pile top, the load of the upper structure of the pile is firstly transferred to a pressure pouring concrete core pile, the load is transferred to the cement soil from the core pile through a binding force between the cement soil and the core pile, and then the load is transferred to the compacted soil layer or permeable layer through a high-pressure cement slurry bonding force between the cement soil and the compacted soil layer (in this way, the transition from the core pile to the soil body through the cement soil forms a gradual changing process of strong, medium and weak, and constitutes a reasonable load-transferring pile structure with high intensity in the middle and low intensity on the periphery), such that the lateral area of the pile is increased, the original frictional resistance between the pile and soil is converted into a shear force of the soil layer except the compacted soil layer, to pull the soil body around the pile to sink together.

(2) The high-speed jet of high-pressure jet grouting cement slurry is used to impact, cut and break formation soil, and cement slurry is filled, mixed, stirred and permeated into soil to solidify into an inverted-cone hard shell with a special structure and a bumpy surface. The bearing capacity of the soil layer compacted by high-pressure spraying outside the hard shell is close to the passive earth pressure. After loading on the pile top, an inverted-frustum inclined plane is subject to a frictional resistance, an adsorption force and a supporting force (the stress state of tangential force and normal force), and the frustum wedge-shaped solid nucleus are extruded outwards symmetrically towards the periphery. Due to the binding effect of the frictional resistance between soil and the inclined plane of the basement on the lateral displacement of the soil particles below the basement, the deeper the pile end is buried, the bigger the binding force on the wedge-shaped basement, a bigger and compacted passive earth pressure supports at the position below and around the frustum, therefore, the expanded body of the jetting, expansion and extrusion combined pile has a big supporting force, if the bearing force of the double-frustum-shaped expanded body is larger than a pile body damage bearing capacity, and the expanded body is deformed slightly, the bearing capacity of a single pile is the damage bearing capacity of a pile body, and settlement deformation is just the elastic deformation of the pile body.

(3) According to the above deformation theory of "the jetting, expansion and extrusion combined pile", after loading on the pile top, the pile body pulls surrounding soil body to sink together, and is simultaneously connected with the soil layer around a frustum, the bearing force (d is equal to 700 mm, $d_1$ is equal to 500 mm, a wing-shaped drill rod, in the sand layer) on the inclined plane of the joint expanded body of rotary jet grouting and drilling is greater than 10000KN (just the elastic deformation of the pile body), the damage of the pile is the damage of the pile body, but the pile head is the weakest link of the pile body, so the length of 1.5 m of the pile head should be solidified on design.

Compared with the prior art, the present invention has the following outstanding effects:

(1) In the present invention, on the concrete pile body or pile end, a dedicated drilling rig with multiple layers of nozzles is used to manufacture a double-frustum-shaped expanded body composed of concrete and cement soil, the diameter of the pile above the expanded body is larger than or equal to that of the pile below the expanded body, the diameter of the pile above the expanded body is sprayed with a wing plate composed of cement soil and concrete, thereby not purely increasing the frictional resistance area, while the cement slurry performing directional jet grouting on the wing plate fills around the whole pile, and plays an effect of post grouting after being extruded by a drill rod.

(2) The spiral hollow drill rod of the drilling rig in the present invention is divided into an upper section and a lower section, the diameter of the upper section is larger than that of the lower section, and the expanded body can be produced in any required position conveniently. When the expanded body is located at the upper part or in the middle of the combined pile, if the diameter of the pile above the expanded body is larger than that of the pile below the expanded body, the consumption of concrete can be greatly reduced.

(3) The dedicated drilling rig in the present invention can be used to drill holes and fill concrete under pressure, the multiple layers of nozzles can perform rotary jet grouting on the double-frustum-shaped expanded body, and can also perform directional jet grouting on the wing plate of the pile body, when the drilling rig is used to form a pile, the process is simple, the cost is low, the drilling rig is applicable to multiple geological conditions, and can manufacture special piles of a double-frustum-shaped expanded body at different positions of the pile body, the structure is simple, the bearing capacity of a single pile is high, the construction speed is fast and the quality is favorable.

(4) The combined pile of the present invention can ensure and improve the bearing capacity of the pile to reduce deformation, and can reduce the consumption of concrete and reduce construction costs.

(5) The superfluid concrete is used to compact the soil layer around the pile hole, such that the highly sprayed cement soil rising along the hole wall is tightly extruded together with the soil layer, and has a permeation effect on the sand layer, thereby improving the frictional resistance of the pile. The pile body is sprayed into a polygon, and the friction area is at least doubled.

(6) The present invention has the following outstanding characteristics: the dedicated drilling rig with multiple layers of nozzles is innovated, the underground soil layer at the frustum is sprayed repeatedly for multiple times under high pressure, to manufacture an inverted cone wedge-shaped expanded body. Due to the binding effect of the frictional resistance between soil and the inclined plane of the basement on the lateral displacement of the soil particles below the basement, the deeper the pile end is buried, the bigger the binding force on the wedge-shaped basement, a bigger and compacted passive earth pressure supports at the position below and around the frustum, only the process and device need to be changed, under the same geographical conditions and material consumption, the bearing force of a single pile can be improved by 2-5 times. The transformation is small, and the process is convenient.

The jetting, expansion and extrusion combined pile and the construction method thereof and the spiral jetting, expansion and extrusion drilling rig using the method are further described below in combination with description of drawings and specific embodiments.

DETAILED DESCRIPTION OF THE EMBODIMENTS

Embodiment 1

Figure 1:
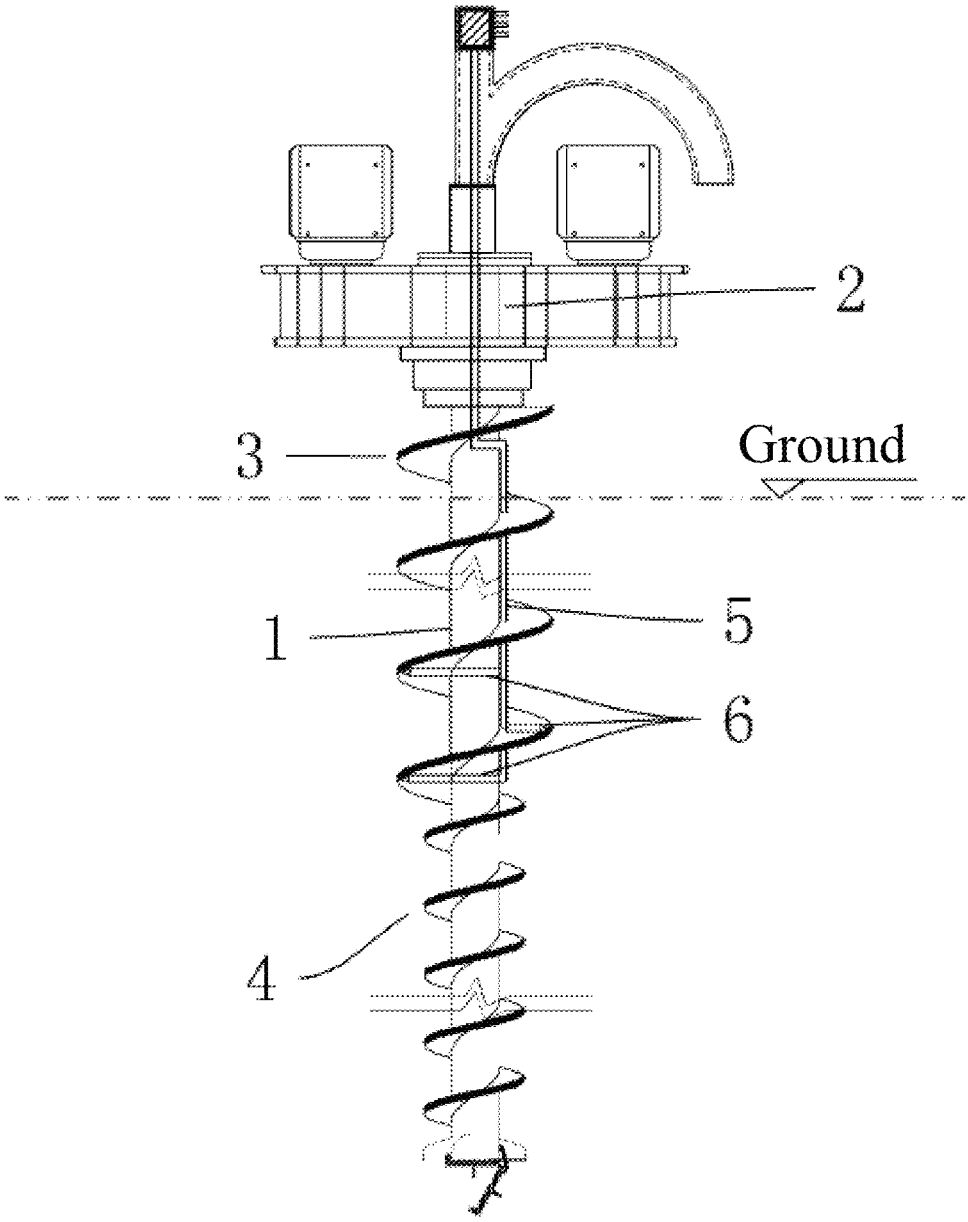
FIG. 1 is a structural schematic diagram of a spiral jetting, expansion and extrusion drilling rig.
Figure 2:
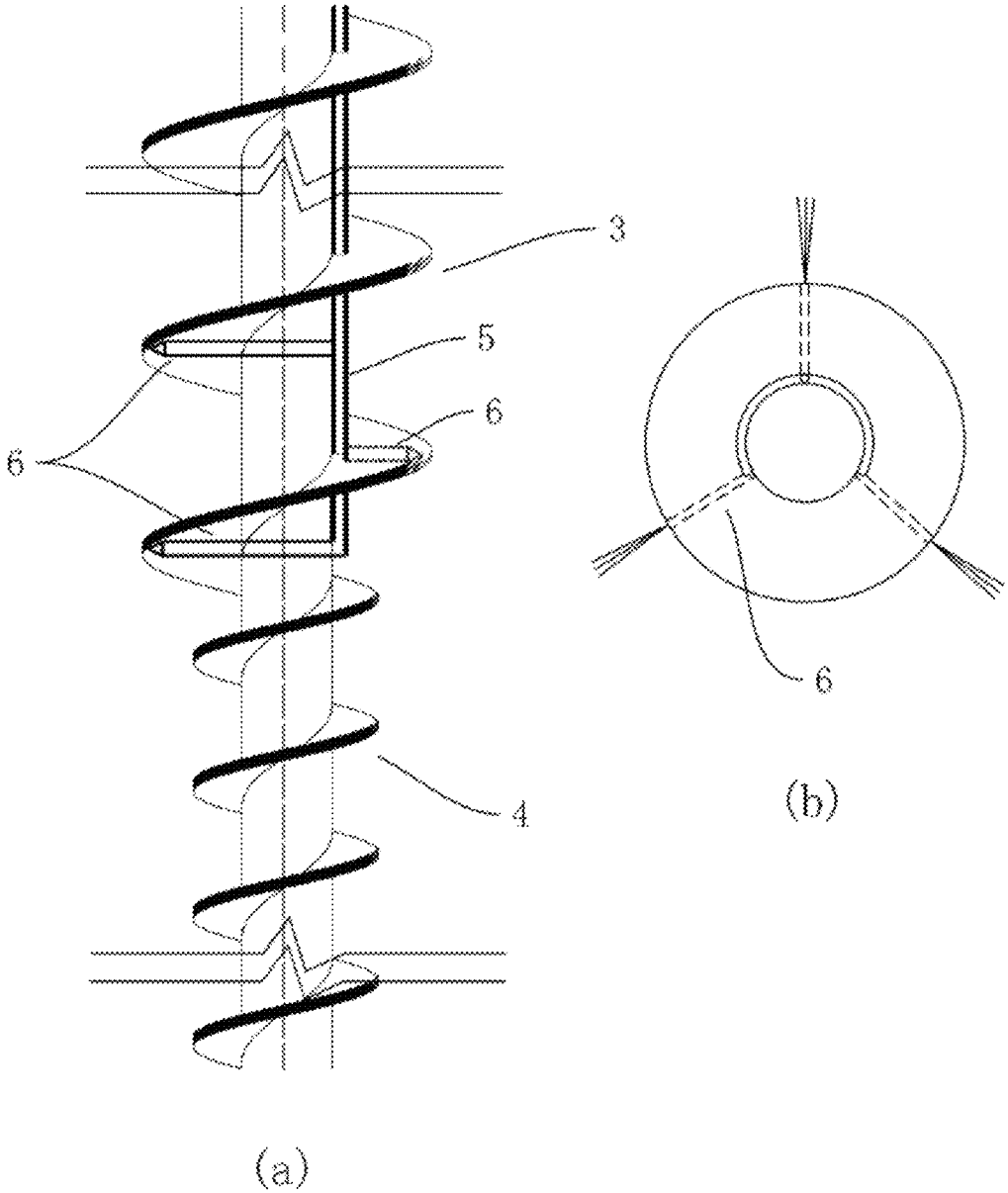
In FIG. 2, (a) is a partial enlarged view of the connecting position of the upper drill rod and the lower drill rod; and (b) is an overhead perspective of the three layers of grout injection nozzles.

In combination with FIG. 1 to FIG. 2, a spiral jetting, expansion and extrusion drilling rig includes a spiral hollow drill rod 1 and a power head 2, and a high-pressure grout injection pipe 5 is installed from top to bottom at one side of an outer wall of a core tube of the spiral hollow drill rod 1, wherein the spiral hollow drill rod 1 includes an upper drill rod 3 and a lower drill rod 4, wherein the upper drill rod 3 and the lower drill rod 4 are connected together through a flange, the radius of the helical blade of the upper drill rod 3 is larger than the radius of the helical blade of the lower drill rod 4, the lower end of the high-pressure grout injection pipe 5 is provided with multiple layers of grout injection nozzles 6, and each layer of grout injection nozzle 6 is located below the outer edge of the helical blade at the bottom of the upper drill rod 3.

The length $l_1$ of the upper drill rod 3 is 6 m, the length $l_2$ of the lower drill rod 4 is 8 m, the diameter d of the upper drill rod 3 is equal to 700 mm, and the diameter $d_1$ of the lower drill rod 4 is equal to 500 mm, and d is equal to the sum of $d_1$ and 0.2 m.

In other deformation embodiments, according to the actual construction requirements, the upper drill rod 3 only needs to ensure that the length his larger than 5 m, and the lower drill rod 4 only needs to ensure that the length $l_2$ is larger than 6 m, the diameter of the upper drill rod 3 can be 700 mm to 800 mm, the diameter of the lower drill rod 4 can be 500 mm to 600 mm, and d is equal to the sum of $d_1$ and 0.2 m.

The number of layers of the grout injection nozzles 6 is 3, and the grout injection nozzles 6 are welded on the last three layers of helical blades at the bottom of the upper drill rod 3. Each layer of grout injection nozzle 6 is provided with two nozzles; the bearing pressure of each nozzle is 2-40 MPa. The spacing between two adjacent upper and lower layers of grout injection nozzles 6 is 20 cm; the horizontal spacing between two adjacent nozzles in each layer of grout injection nozzle 6 is 4 cm, and the diameter of the nozzle is 2 mm.

In other deformation embodiments, according to actual construction requirements, the number of layers of grout injection nozzles 6 is 2-10. Each layer of grout injection nozzle 6 can be provided with 1-6 nozzles; the bearing pressure of each nozzle is 2-40 MPa. The spacing between two adjacent upper and lower layers of grout injection nozzles 6 is 5-30 cm; the horizontal spacing between two adjacent nozzles in each layer of grout injection nozzle 6 is 1-6 cm, and the diameter of the nozzle is 2-10 mm.

Embodiment 2

Figure 3:
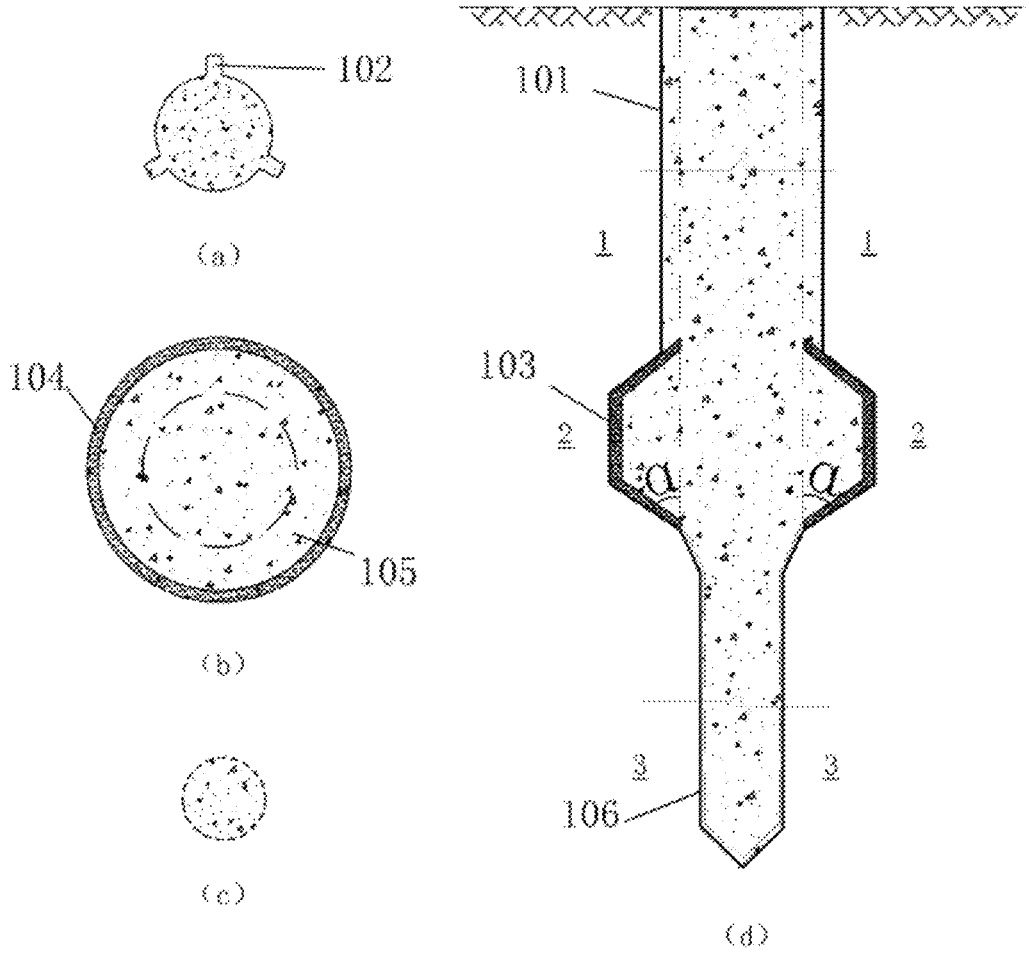
in FIG. 3, (a) is a sectional view of the 1-1 section in FIG. 3*d*, (b) is a sectional view of 2-2 section in FIG. 3*d*, (c) is the sectional view of 3-3 section in FIG. 3*d*, and (d) is the structural schematic diagram of the combined pile in which the expanded body is located in the middle of the combined pile and the sectional view of each part.

As shown in FIG. 3, a jetting, expansion and extrusion combined pile with a high bearing capacity is provided, and the pile is composed of a pile body 101, an expanded body 103 and a pile end 106, wherein the pile body 101 is provided with at least one double-frustum-shaped expanded body 103 which is integrally formed with the pile body. The pile body is internally provided with a reinforcement cage. The double-frustum shape is a structure which is big in the middle and gradually smaller in the upper and lower parts.

The expanded body 103 is arranged at the sand layer at which the pile body 101 is located, the pile body 101 is provided with a layer of wing plates 102 which are basically perpendicular to the axis of the pile body, three wing plates 102 are arranged on each layer, and are uniformly distributed in the circumference direction. The wing plate 102 has a width of 5-25 cm and a thickness of 2-12 cm.

The diameter of the pile above the expanded body 103 is larger than that of the pile below the expanded body 103.

The included angle $\alpha$ between the lower inclined plane of the expanded body 103 and the central axis of the pile is in a range of greater than or equal to 10° and less than or equal to 80°.

The expanded body 103 is a high-pressure jet grouting double-frustum-shaped rigid expanded body which is formed when a drill bit vibrates to extrude the superfluid concrete to form a concrete expanded head 105 and which is externally wrapped with a layer of compacted cement soil 104 and concrete.

Figure 4:
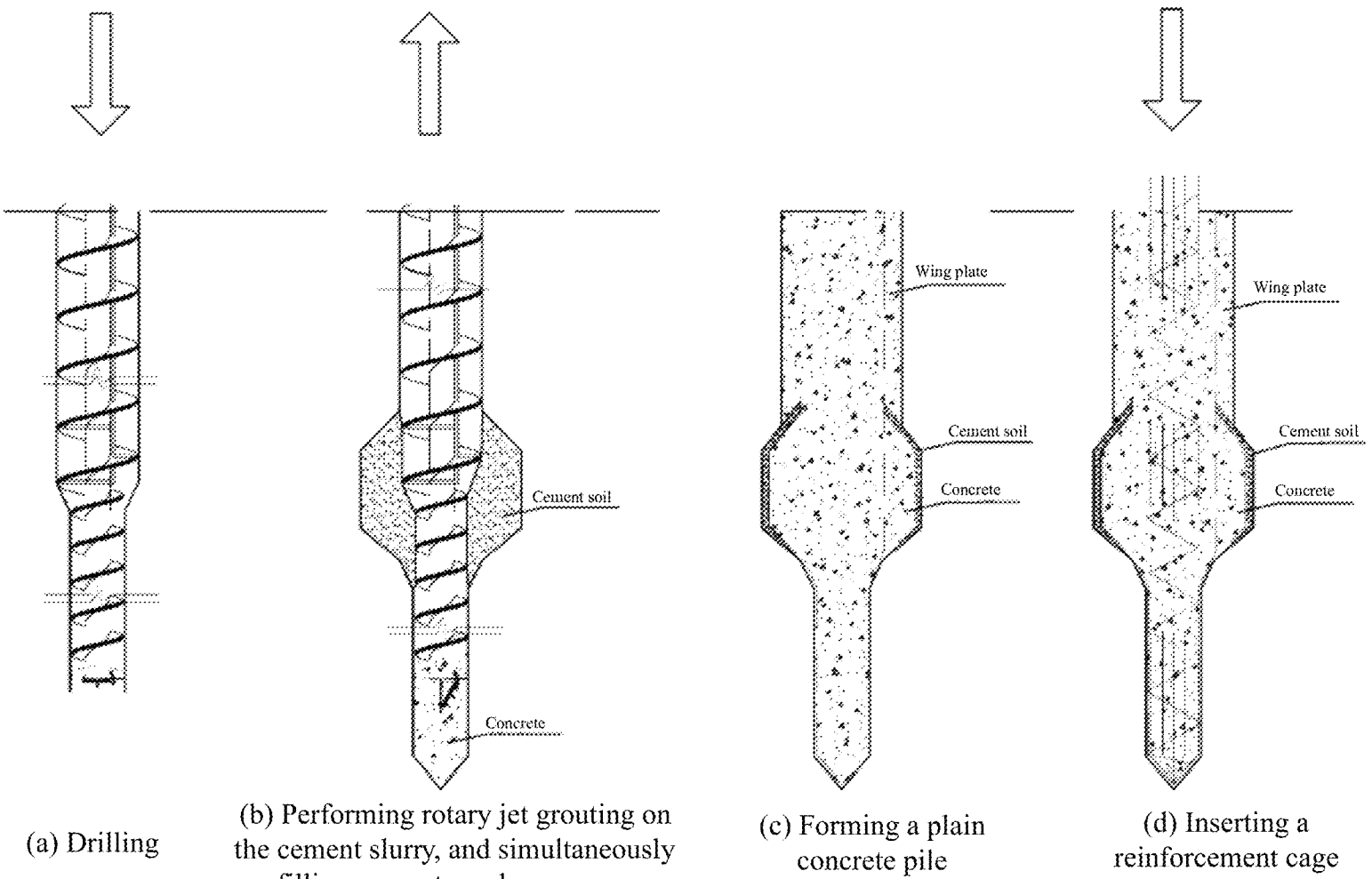
in FIG. 4, (a) to (d) are schematic diagrams of the construction step of the combined pile in FIG. 3.

The specific steps of the construction method are as follows:

(1) drilling through the drilling rig of embodiment 1 and the three-point pile-driver tower, as shown in FIG. 4*a*, drilling to a designed depth, and stopping rotating the drill rod;

(2) adjusting the nozzle pressure of the grout injection nozzle on the drill rod to 20 MPa, and adjusting the lifting speed of the drill rod to 20 cm/min; while lifting the spiral hollow drill rod, performing rotary jet grouting on the cement slurry at the designed depth with a nozzle on the grout injection nozzle, filling superfluid concrete under pressure by the vibration of the drill rod, to manufacture the double-frustum-shaped expanded body to a designed elevation, with the height being 2.0 m, as shown in FIG. 4*b;*

(3) adjusting the lifting speed of the drill rod to 1.5 m/min, keeping the nozzle pressure unchanged, changing from performing rotary jet grouting to performing directional jet grouting on the wing plate of the pile body, and simultaneously filling superfluid concrete under pressure to a designed elevation; spraying at three directions when the wing plate of a pile body is subjected to directional jet grouting, as shown in FIG. 4*c*, to form the plain concrete pile; and (4) inserting the reinforcement cage into superfluid concrete in a pile hole to a designed depth, to form a reinforced concrete foundation pile, as shown in FIG. 4*d*.

In other deformation embodiments, according to actual construction requirements, wherein the nozzle pressure of the grout injection nozzle in step (2) can be 2-40 MPa, the lifting speed of the drill rod can be 6-60 cm/min; the height of the double-frustum-shaped expanded body can be 0.5-3.0 m. The lifting speed of the drill rod in step (3) can be 0.5-2 m/min.

Embodiment 3

Figure 5:
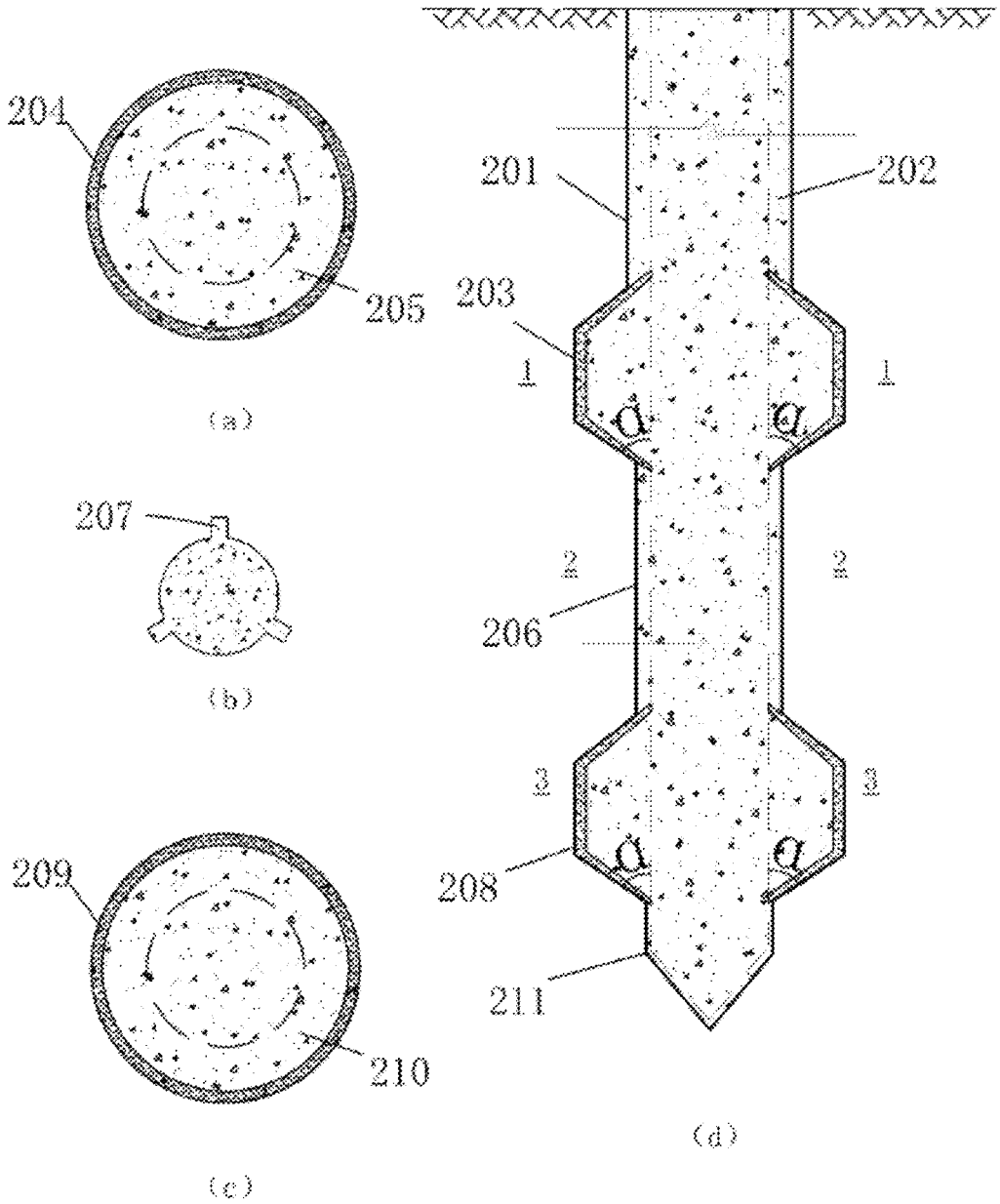
in FIG. 5, (a) is the sectional view of 1-1 section in FIG. 5*d*, (b) is the sectional view of 2-2 section in FIG. 5*d*, (c) is the sectional view of 3-3 section in FIG. 5*d*, and (d) is the structural schematic diagram of the combined pile in which the expanded body is located in the middle of the combined pile and the sectional view of each part.

As shown in FIG. 5, a jetting, expansion and extrusion combined pile with a high bearing capacity is provided. The pile is composed of a pile body 201, an expanded body 203, a pile body 206, the expanded body 208 and a pile end 211, wherein the expanded body 203 and the expanded body 208 are both double-frustum-shaped and are integrally formed with the pile body. The pile is internally provided with a reinforcement cage. The double-frustum shape is a structure which is big in the middle and gradually smaller in the upper and lower parts.

The expanded body 203 and the expanded body 208 are arranged in a vertical bearing layer position, which has higher shear strength, of the pile body. The pile body 201 and the pile body 206 are respectively provided with a layer of wing plates (202, 207) which are basically perpendicular to the axis of the pile body, three wing plates are arranged on each layer, and are uniformly distributed in the circumference direction. The wing plate has a width of 5-25 cm and a thickness of 2-12 cm.

The maximum diameter of the pile above the expanded body 203 is larger than that of the pile below the expanded body 203. The maximum diameter of the pile above the expanded body 208 is equal to that of the pile below the expanded body 208.

The included angle $\alpha$ between the lower inclined plane of the expanded body 203 and the expanded body 208 and the central axis of the pile is in a range of greater than or equal to 10° and less than or equal to 80°.

The expanded body 203 is a high-pressure jet grouting double-frustum-shaped rigid expanded body which is formed when a drill bit vibrates to extrude the superfluid concrete to form a concrete expanded head 205 and which is externally wrapped with a layer of compacted cement soil 204 and concrete.

The expanded body 208 is a high-pressure jet grouting double-frustum-shaped rigid expanded body which is formed when a drill bit vibrates to extrude the superfluid concrete to form a concrete expanded head 210 and which is externally wrapped with a layer of compacted cement soil 209 and concrete.

The above embodiments are merely to describe the preferred embodiments of the present invention, rather than limiting the scope of the present invention. Under the premise of not departing from the designed spirit of the present invention, various transformations and improvements made to the technical solutions of the present invention by those skilled in the art shall all fall within the protection scope determined by the claims of the present invention.

INDUSTRIAL APPLICABILITY

The dedicated drilling rig in the present invention can be used to drill holes and fill concrete under pressure, the multiple layers of nozzles can perform rotary jet grouting on the double-frustum-shaped expanded body, and can also perform directional jet grouting on the wing plate of the pile body, when the drilling rig is used to form a pile, the process is simple, the cost is low, the drilling rig is applicable to multiple geological conditions, and can manufacture special piles of a double-frustum-shaped expanded body at different positions of the pile body; as to the double-frustum-shaped expanded body composed of concrete and cement soil, the diameter of the pile above the expanded body is larger than or equal to that of the pile below the expanded body, the diameter of the pile above the expanded body is sprayed with a wing plate composed of cement soil and concrete, thereby not purely increasing the frictional resistance area, while the cement slurry performing directional jet grouting on the wing plate fills around the whole pile, and plays an effect of post grouting after being extruded by a drill rod; and the dedicated drilling rig has favorable industrial applicability.

The invention claimed is:

1. A jetting, expansion and extrusion combined pile with a high bearing capacity, wherein the pile is composed of a pile body, an expanded body and a pile end, and at least one double-frustum-shaped expanded body, which is integrally formed with the pile body, is arranged on the pile body, wherein the double-frustum-shaped expanded body is a high-pressure jet grouting double-frustum-shaped rigid expanded body externally wrapped with a layer of compacted cement soil and concrete.

2. The jetting, expansion and extrusion combined pile of claim 1, wherein the pile is internally provided with a reinforcement cage.

3. The jetting, expansion and extrusion combined pile of claim 1, wherein the expanded body is located in a vertical bearing layer position, which has higher deformation modulus and shear strength, of the pile body, and at least two wing plates which are uniformly distributed in a circumference direction and perpendicular to the axis of the pile are arranged on the pile body.

4. The jetting, expansion and extrusion combined pile of claim 3, wherein a diameter of the pile above the expanded body is larger than or equal to that of the pile below the expanded body.

5. The jetting, expansion and extrusion combined pile of claim 4, wherein an included angle $\alpha$ between a lower inclined plane of the expanded body and a central axis of the pile is in a range of greater than or equal to 10° and less than or equal to 80°.

6. The jetting, expansion and extrusion combined pile of claim 5, wherein the wing plate has a width of 5-25 cm and a thickness of 2-12 cm.

7. A construction method of the jetting, expansion and extrusion combined pile of claim 1, comprising the following steps:

(1) drilling to a designed depth through a drilling rig, and stopping drilling;

(2) adjusting a nozzle pressure of a grout injection nozzle on a drill rod to 2-40 MPa, and adjusting the lifting speed of the drill rod to 6-60 cm/min; and while lifting a spiral hollow drill rod, performing rotary jet grouting on cement slurry at the designed depth with the nozzle on the grout injection nozzle, and vibrating a drill rod to fill under pressure a superfluid concrete to manufacture a double-frustum-shaped expanded body to a set elevation, with a height being 0.5-3.0m; and (3) adjusting the lifting speed of the drill rod to 0.5-2m/min, keeping the nozzle pressure to be unchanged, changing from performing rotary jet grouting to performing directional jet grouting on the wing plate of the pile body, and simultaneously filling under pressure the superfluid concrete to a designed elevation, to form a plain concrete pile.

8. The construction method of claim 7, wherein after the plain concrete pile is formed, a reinforcement cage is inserted into the superfluid concrete in a pile hole to a designed depth, to form a reinforced concrete foundation pile.

9. A spiral jetting, expansion and extrusion drilling rig adopted in the construction method of claim 7, comprising a spiral hollow drill rod and a power head, and a high-pressure grout injection pipe is installed from top to bottom at one side of an outer wall or an inner wall of a core tube of the spiral hollow drill rod, wherein the spiral hollow drill rod comprises an upper drill rod and a lower drill rod, wherein the upper drill rod and the lower drill rod are connected together through a flange, the radius of the helical blade of the upper drill rod is larger than the radius of the helical blade of the lower drill rod, the lower end of the high-pressure grout injection pipe is provided with multiple layers of grout injection nozzles, and each layer of grout injection nozzle is located below the outer edge of the helical blade at the bottom of the upper drill rod.

10. The spiral jetting, expansion and extrusion drilling rig of claim 9, wherein the length $l_1$ of the upper drill rod is larger than 5m, the length $l_2$ of the lower drill rod is larger than 6m, the diameter d of the upper drill rod is equal to 700 mm to 800 mm, and the diameter $d_1$ of the lower drill rod is equal to 500 mm to 600 mm, and d is equal to the sum of $d_1$ and 0.2m.

11. The spiral jetting, expansion and extrusion drilling rig of claim 10, wherein the number of layers of the grout injection nozzles is 2-10.

12. The spiral jetting, expansion and extrusion drilling rig of claim 11, wherein each layer of grout injection nozzle is provided with 1-6 nozzles, and the bearing pressure of each nozzle is 2-40 MPa.

13. The spiral jetting, expansion and extrusion drilling rig of claim 12, wherein the spacing between two adjacent upper and lower grout injection nozzles is 5-30 cm, the horizontal spacing between two adjacent nozzles in each layer of grout injection nozzle is 1-6 cm, and the diameter of the nozzle is 2-10 mm.

14. The spiral jetting, expansion and extrusion drilling rig of claim 13, wherein the number of layers of the grout injection nozzles is 3, each layer of grout injection nozzle is provided with two nozzles, and the diameter of the nozzle is 2 mm.

* * * * *